US005299410A

United States Patent [19]

Freeman

[11] Patent Number: 5,299,410

[45] Date of Patent: Apr. 5, 1994

[54] PACKAGING MECHANISM AND METHOD

[75] Inventor: Jon Freeman, Norwich, Conn.

[73] Assignee: Gunther International, Ltd., Norwich, Conn.

[21] Appl. No.: 972,302

[22] Filed: Nov. 5, 1992

[51] Int. Cl.[5] ..... B65B 11/08; B65B 53/02; B65B 59/02

[52] U.S. Cl. ..... 53/442; 53/66; 53/504; 53/553; 53/557

[58] Field of Search ..... 53/504, 66, 64, 503, 53/477, 463, 553, 548, 373.7, 374.3, 557, 556, 442, 441

[56] References Cited

U.S. PATENT DOCUMENTS

| | | | |
|---|---|---|---|
| 3,158,973 | 12/1964 | Monaghan | 53/66 |
| 3,552,088 | 6/1971 | Niwa | 53/66 X |
| 3,731,452 | 5/1973 | Rias . | |
| 4,501,106 | 2/1985 | Treiber et al. | 53/66 |
| 4,887,412 | 12/1989 | Takamura | 53/66 X |

*Primary Examiner*—James F. Coan
*Attorney, Agent, or Firm*—Ware, Fressola, Van Der Sluys & Adolphson

[57] ABSTRACT

Mechanism and means for enclosing a package in a wrap. The external dimensions of the package are first determined and sufficient wrap is fed with which to enclose the package. Depending on the external dimensions of the package, the amount of wrap fed is adjusted and thereafter the package is enclosed in the wrap.

17 Claims, 2 Drawing Sheets

PACKAGING MECHANISM AND METHOD

BACKGROUND

The present invention relates to a packaging mechanism and method and more particularly to a packaging mechanism and method which is adapted to be used for form a shrink wrap package which will shrink wrap stacks of paper of different sizes.

In the prior art, a number of shrink wrapping machines have been in use which are adapted to be adjusted to shrink wrap packages of different sizes. In doing this, a shrink wrapping machine is adjusted to shrink wrap packages of the same size for a particularly run of same sized packages to be wrapped. If a different size package is to be wrapped, the machine is adjusted so that the machine will now package a series of packages all having the same size but different than the original size batch. If a third series of packages having different sizes to be wrapped, the machine is again adjusted to wrap a number of packages of the same size but different than the other two sizes. The adjustment of the machine can be manual or by some automatic means.

There is no shrink wrap machine that will take various sizes of packages dynamically and apply the proper amount of plastic film for that package, be it large or small, nor is there any mechanism for automatically adjusting the machine for that particular size package and dispense the film so that the shrink wrapping will be proper. In other words, existing machines do not have the capability of packaging bundles of documents of different sizes as each different size is presented to the wrapping machines. In some industries, such as the insurance industry, insurance contracts are of different thicknesses depending on the types of papers in each insurance contract. Hence, for example, one insurance policy may be about 1,000 pages and the very next policy may be 50 pages and the one after that may be about 750 pages. As another example, the packages being shrink wrapped may vary from one inch to three inches one after the other. In addition, the packages being processed may vary in width and/or length as well as in height. If all these are to be shrink wrapped and are presented to the shrink wrapping machine one after the other, the machine would have to be stopped and adjusted for each package. It will be appreciated that this would be time consuming, expensive and impractical.

Presently, shrink wrapping machines are adjustable to handle various size packages. However, manual adjustments must be made for each size package that is to be shrink wrapped. This is only natural in that probably 99 percent of the shrink wrapping machines are packaging the same item over and over again. However, in the electronic publishing field it is possible to turn out a 3 page report followed by a 40 page report, etc., followed by a six page report. This is more the normal operation rather than the exception in non-impact computer printing. Since these printed reports must be sent to various offices or locations, it is necessary to wrap them in a package suitable for the size of the reports.

OBJECTS

The present invention overcomes these drawbacks and has for one of its objects the provision of an improved shrink package mechanism in which the machine can automatically adjust itself to package bundles of different sizes one after the other.

Another object of the present invention is the provision of an improved shrink wrap machine which has means to sense the size of the bundle to be wrapped and which will automatically adjust the machine to that size.

Another object of the present invention is the provision of an improved shrink wrap machine in which the height may be adjusted to permit bundles of varying heights to be shrink wrapped.

Another object of the present invention is the provision of an improved shrink wrap machine in which the width may be adjusted to permit bundles of varying widths to be shrink wrapped.

Another object of the present invention is the provision of an improved shrink wrap machine in which the length may be adjusted to permit bundles of varying lengths to be shrink wrapped.

Another object of the present invention is the provision of an improved shrink wrap machine in which the height lengths and widths may be adjusted to permit bundles of varying heights, lengths and widths to be shrink wrapped.

Another object of the present invention is the provision of an improved shrink wrap machine which may be easily operated remotely.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
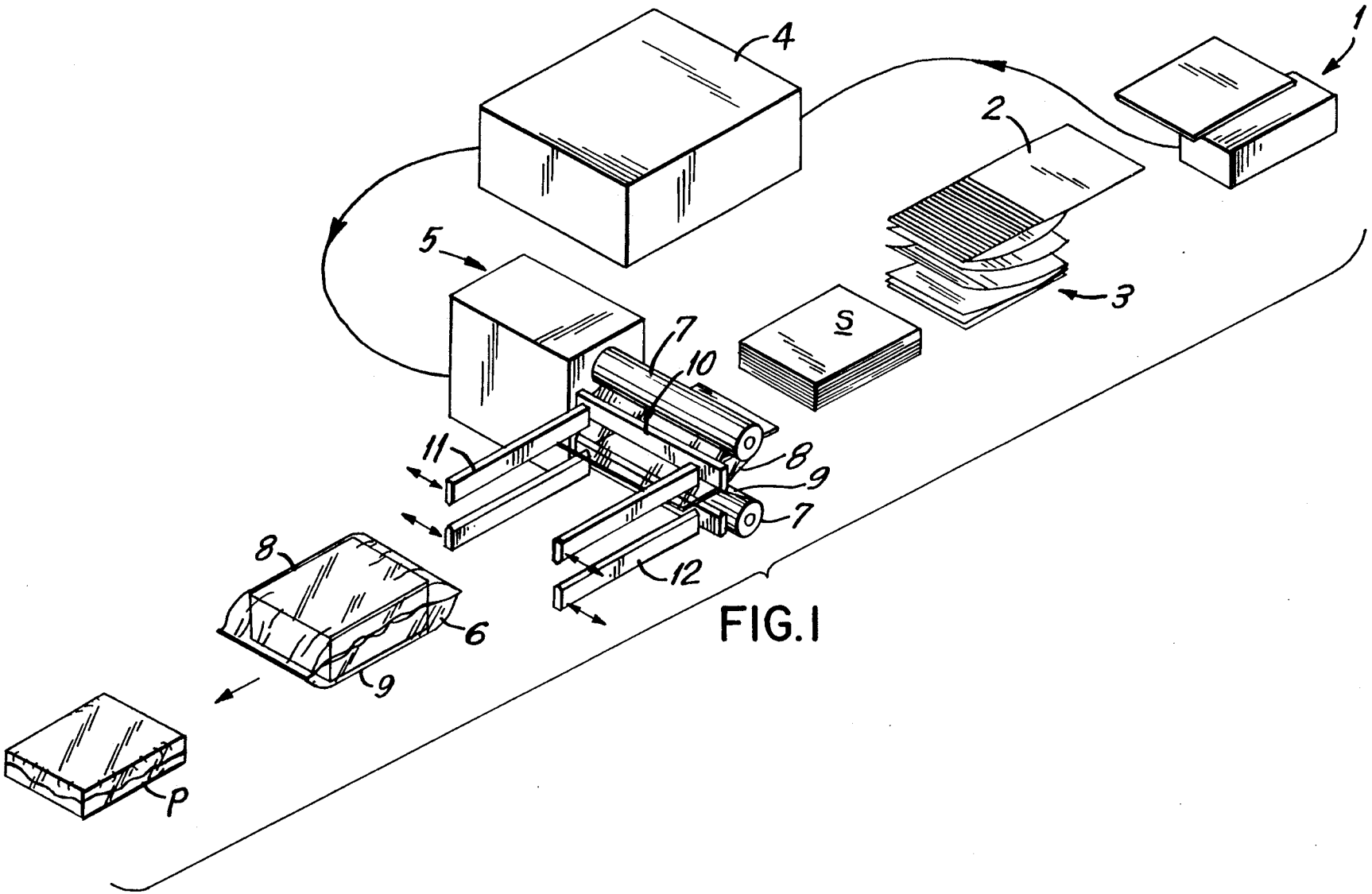
FIG. 1 is a diagrammatic perspective view of the preferred embodiment of a machine embodying the present invention.

Referring to drawings and more particularly to FIG. 1, a document feeder 1, or some other similar mechanism, is provided which feeds documents 2 to an assembly station 3. The document feeder 1 may be pre-programmed to feed a certain number of documents 2. It sends the information to a control module or a computer 4 which, in turn, sends the information to a wrap sealing module 5. When the documents are assembled in the assembly station 3 they are then moved in a stack S to the sealing module 5 to be shrink wrapped by a plastic wrap 6. The information that has been transferred by the control module 4 to the sealing module 5 has information concerning the size parameters of the stack that is to be shrink wrapped. Top and bottom rolls 7 of sealing plastic wrap 8 and 9 are provided between which the stack S passes. The rolls 7 feed the plastic wrap 8 and 9 both to the top and underside of the stack S. Transverse seal 10 and longitudinal seals 11 and 12 are provided and each comprise a pair of vertically movable heat seal knives which are moved together to press and heat the laminates 8 and 9 together to seal them. The seals 10, 11 and 12 are manipulated to seal upper and lower laminates 8 and 9 together. The transverse seals 10 seal both the front and rear of the laminates together. After being sealed, the package is sent through a shrink wrap tunnel (not shown) which shrinks the seal to form the final package.

In the embodiment shown in FIG. 1, responsive to the information stored in the computer 4 the seal module 5 is operated automatically so that sufficient amounts of sealing wrap 8 and 9 is conveyed from the rolls 7 and that the side sealing knives 11 and 12 are moved inwardly and outwardly, i.e., toward and away from each other to accommodate the size of the stack S. Hence, when a particular size stack passes by the seal module 5, the sealing knives 11 and 12, as well as the roller 7, have already been instructed to feed sufficient number of wrap 8 and 9 to cover the stack S and to seal the stack.

The very next stack may be of a completely different size and the computer 4 again instructs the seal module 5 to adjust itself (i.e., rolls 7 and knives 11-12) to the new size. In effect, the knives 11 and 12 are movable horizontally, not only to accommodate the upper and lower laminates 9-10 to the height of the stack S, but also to accommodate the upper and lower laminates 8-9 to wider and narrower stacks. If the stack is narrow, the knives are brought closer together to each other to remove less of the laminates 8-9. Contrariwise, if the stack is wider, the knives are moved further apart in order to coat more of the laminate 8-9 to completely cover the stack.

Hence, the present invention provides a completely versatile mechanism in which the laminates for shrink wrapping may be moved further apart or closer together in order to accommodate stacks of various heights, as well as stacks of varied widths. It will thus be seen that by instructions sent to the computer 4 by the feeder 1 and the computer to the seal module 5 as to the dimensions of the package, time it is to seal a package, the seal module 5 adjusts itself to the proper size.

While this embodiment has been described with respect to a computer 4 which has been fed with information from a document feeder 1, it will be understood that it is within the purview of the present invention not to use a computer to control the location of the knives. For example, each stack may be sensed or measured for size by any sensing means before it reaches the seal module 5. The sensing means (not shown) would measure the width, height and the length of the stack to be conveyed to the seal module 5 which will then control the position of the knives 11-12 and the roller 7 to move outwardly and inwardly to feed and seal more or less of the laminate 8-9 for shrink-wrapping packages of different heights, widths and/or lengths.

Figure 2:
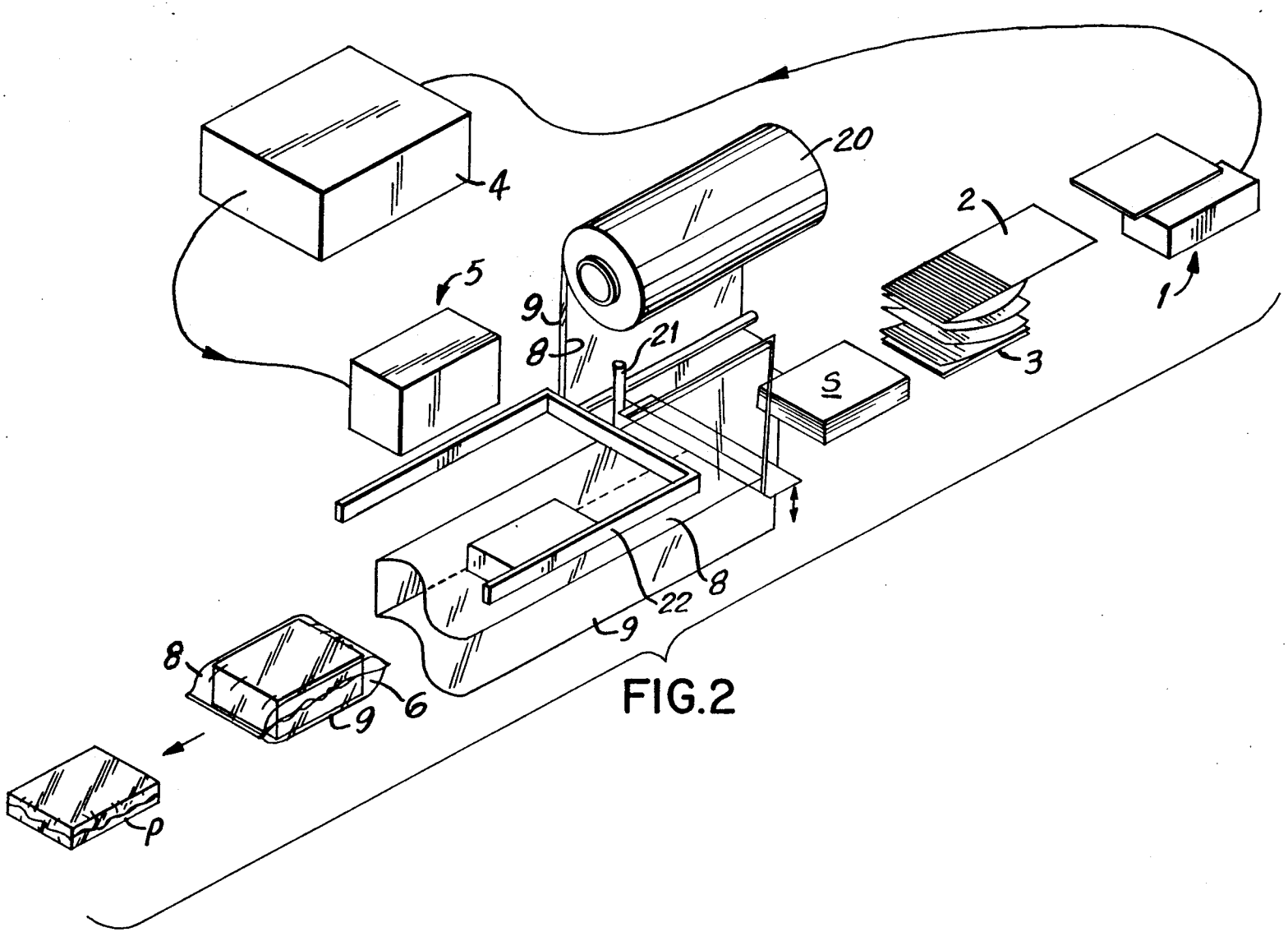
FIG. 2 is a diagrammatic perspective view showing another embodiment of the present invention.

FIG. 2 shows another embodiment of this invention. In this embodiment, the sealer module 5 is an L-sealer in which a single roll of wrap 20 is fed to provide the upper and lower laminates 8-9 of the wrap 6. The upper and lower laminates 8-9 are fed from the roll 20 and are then moved at right angles and spread apart so that they move longitudinally. Again, operating under command from the computer 4, or any other sensing mechanism, an adjustment piston 21 is moved up or down to feed the proper amount of wrap 6 that is necessary to completely cover the stack S. The wrap covered stack then moves to the sealing area 22 which seals the edges in a manner similar to embodiment shown in FIG. 1. The very next series of packages to be wrapped may be of different sizes and upon command from the computer 4 which receives its information from the feeder 1, the seal module 5 adjusts itself to accommodate the sizes as each size stack is presented to it.

Although this embodiment has been described with respect to a computer, the use of other types of sensing means can be used to sense the measurements of the package to be shrink-wrapped and to feed the proper amount of laminate to cover the particular package being processed.

It will thus be seen that the present invention provides an improved shrink wrap machine which has means to sense the size of the bundle to be wrapped and which will automatically adjust the machine to that size and an improved shrink wrap machine which may be easily operated remotely.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechanism for enclosing variable size packages individually in a shrink wrap, each package having generally rectangular top and bottom surfaces with a pair of end surfaces and a pair of side surfaces extending therebetween so as to define a length, width and height as external dimensions of the package, the mechanism comprising:
   (a) sensing means for determining the external dimensions of each package to be wrapped;
   (b) means for feeding a shrink wrap with which to enclose the package;
   (c) means responsive to said sensing means for determining the external dimensions of each package for automatically adjusting the amount of shrink wrap fed by said shrink wrap feeding means based upon the external dimensions determined by said sensing means; and
   (d) means for enclosing the package in said shrink wrap.

2. A mechanism as set forth in claim 1 wherein said means for feeding includes means for feeding a pair of shrink wraps and further including means to place the package between the shrink wraps.

3. A mechanism as set forth in claim 1 wherein said means for feeding a shrink wrap includes means for feeding a pair of shrink wraps with a space between the pair of shrink wraps being automatically adjusted responsive to the external dimensions of each package to be wrapped.

4. A mechanism as set forth in claim 1 wherein said wrap is a shrink seal wrap.

5. A mechanism as set forth in claim 1 wherein said enclosing means are heat seal knives adapted to seal the shrink wrap around each package to be wrapped.

6. A mechanism as set forth in claim 5 wherein said heat seal knives are located adjacent each of the side surfaces and at least one of the end surfaces of the package and said enclosing means further including means responsive to said sensing means for determining the external dimensions of the package to positionally adjust the heat seal knives relative to each other and to each package to be wrapped.

7. A mechanism as set forth in claim 6 wherein said shrink wrap is a shrink seal laminate.

8. A mechanism as set forth in claim 1 wherein said enclosing means are seal means and further include means responsive to said sensing means for determining the external dimensions of the package to automatically positionally adjust the seal means relative to each package to be wrapped.

9. A method of enclosing variable size packages individually in a shrink wrap, each package having generally rectangular top and bottom surfaces with a pair of end surfaces and a pair of side surfaces extending therebetween so as to define a length, width and height as external dimensions of the package, the mechanism comprising the steps of:

(a) providing a package to be wrapped;

(b) sensing the package to be wrapped to determine the external dimensions of the package;

(c) providing means for feeding a shrink wrap with which to enclose the package;

(d) automatically adjusting said feeding means to feed a desired amount of shrink wrap responsive to the sensed external dimensions of the package; and (e) enclosing the package in said shrink wrap.

10. A method set forth in claim 9 wherein said enclosing step includes providing heat seal knives to seal the shrink wrap around the package.

11. A method as set forth in claim 10 wherein said heat seal knives are adjacent each side surface and at least one of the end surfaces of the package and are adjustably positionable relative to each other and to the package responsive to the sensed external dimensions of the package.

12. A method set forth in claim 11 wherein said shrink wrap is a shrink seal laminate.

13. A method as set forth in claim 9 wherein said means for feeding a shrink wrap includes means for feeding a pair of shrink wraps and said adjusting step includes feeding sufficient amount of the pair of shrink wraps responsive to the sensed external dimensions of the package.

14. A method as set forth in claim 9 wherein said enclosing step includes providing seal means adjustably positionable responsive to the sensed external dimensions of the package.

15. A method as set forth in claim 9 wherein said wrap is a shrink seal wrap.

16. A method as set forth in claim 9 wherein said means for feeding a shrink wrap includes means for feeding a pair of shrink wraps with a space between the pair of shrink wraps being automatically adjusted responsive to the sensed external dimensions of the package.

17. A method as set forth in claim 14 wherein said enclosing step includes adjustably positioning the seal means relative to the package responsive to the sensed external dimensions of the package.

* * * * *